US008468647B2

(12) United States Patent
Lambourn

(10) Patent No.: US 8,468,647 B2
(45) Date of Patent: Jun. 25, 2013

(54) SURFACE TREATING HEAD

(75) Inventor: Henry Licming Lambourn, Malmesbury (GB)

(73) Assignee: Dyson Technology Limited, Wiltshire (GB)

( * ) Notice: Subject to any disclaimer, the term of this patent is extended or adjusted under 35 U.S.C. 154(b) by 475 days.

(21) Appl. No.: 12/722,145

(22) Filed: Mar. 11, 2010

(65) Prior Publication Data

US 2010/0229339 A1 Sep. 16, 2010

(30) Foreign Application Priority Data

Mar. 12, 2009 (GB) ..... 0904254.0

(51) Int. Cl.
*A47L 9/04* (2006.01)

(52) U.S. Cl.
USPC ..... 15/375; 15/373; 15/421; 15/414

(58) Field of Classification Search
USPC ..... 15/398, 400, 414, 415.1, 375, 373, 15/421
See application file for complete search history.

(56) References Cited

U.S. PATENT DOCUMENTS

| | | | | |
|---|---|---|---|---|
| 2,703,903 | A * | 3/1955 | Faith-Ell | 15/365 |
| 3,497,903 | A | 3/1970 | Jonsson | |
| 3,599,271 | A | 8/1971 | Ljung et al. | |
| 3,659,312 | A | 5/1972 | Mattsson | |
| 3,660,864 | A | 5/1972 | Schwartz | |
| 3,768,114 | A | 10/1973 | Schwartz | |
| 3,798,704 | A | 3/1974 | Kilstrom et al. | |
| 4,180,887 | A * | 1/1980 | Wudel et al. | 15/415.1 |
| 4,336,628 | A * | 6/1982 | Bradshaw et al. | 15/415.1 |
| 4,447,931 | A | 5/1984 | Lindqvist | |
| 4,564,972 | A * | 1/1986 | Varin | 15/358 |
| 4,638,526 | A | 1/1987 | Murata et al. | |
| 4,888,852 | A * | 12/1989 | Varin | 15/400 |
| 5,123,141 | A | 6/1992 | Erickson et al. | |

(Continued)

FOREIGN PATENT DOCUMENTS

| | | |
|---|---|---|
| CN | 1187980 | 7/1998 |
| DE | 26 02 969 A1 | 7/1977 |

(Continued)

OTHER PUBLICATIONS

International Search Report and Written Opinion mailed Jul. 21, 2010, directed to counterpart International Application No. PCT/GB2010/050336; 19 pages.

(Continued)

*Primary Examiner* — William Gilbert
*Assistant Examiner* — Alp Akbasli
(74) *Attorney, Agent, or Firm* — Morrison & Foerster LLP

(57) ABSTRACT

A surface treating head in the form of a floor tool for a vacuum cleaner includes a main body, a suction cavity and an outlet. The suction cavity includes first and second suction channels bounded on both sides by respective working edges. A fluid flow path extends from the first suction channel to the second suction channel and from there to the outlet. The plurality of suction channels permits effective pick-up of dirt, which may be further enhanced by an air duct, in the form of a slot, which draws air over some of the working edges. The invention permits a tool with a lower profile to be manufactured than would be achievable by providing separate flow paths between the respective channels and the outlet.

17 Claims, 7 Drawing Sheets

U.S. PATENT DOCUMENTS

| | | | | |
|---|---|---|---|---|
| 5,539,953 | A * | 7/1996 | Kurz | 15/367 |
| 5,553,349 | A | 9/1996 | Kilstrom et al. | |
| 5,564,161 | A * | 10/1996 | Glatz | 15/415.1 |
| 6,009,594 | A | 1/2000 | Grey | |
| 7,069,620 | B2 * | 7/2006 | Bagwell | 15/398 |
| 7,467,439 | B2 | 12/2008 | Lijzenga et al. | |
| 7,584,522 | B1 * | 9/2009 | Weeter et al. | 15/350 |
| 2003/0163889 | A1 * | 9/2003 | Bagwell | 15/398 |
| 2005/0120512 | A1 | 6/2005 | Choi | |
| 2006/0213026 | A1 | 9/2006 | Lijzenga et al. | |
| 2010/0319159 | A1 | 12/2010 | Gell et al. | |
| 2011/0010886 | A1 | 1/2011 | Arthey et al. | |
| 2011/0010889 | A1 | 1/2011 | Arthey et al. | |
| 2011/0010890 | A1 | 1/2011 | Dimbylow et al. | |

FOREIGN PATENT DOCUMENTS

| | | |
|---|---|---|
| DE | 31 31 380 | 2/1983 |
| DE | 3602926 | 8/1987 |
| DE | 199 33 449 | 11/2000 |
| DE | 203 12 836 | 1/2004 |
| EP | 1 092 380 | 4/2001 |
| EP | 1 320 317 B1 | 2/2007 |
| EP | 1 875 846 | 1/2008 |
| EP | 2 027 805 | 2/2009 |
| FR | 1545346 | 11/1968 |
| FR | 2 696 633 | 4/1994 |
| FR | 2 773 317 | 7/1999 |
| FR | 2 792 817 | 11/2000 |
| FR | 2 871 046 | 12/2005 |
| GB | 851185 | 10/1960 |
| GB | 1077574 | 8/1967 |
| GB | 1190219 | 4/1970 |
| GB | 1 289 381 | 9/1972 |
| GB | 1 289 468 | 9/1972 |
| GB | 1 315 024 | 4/1973 |
| GB | 1 328 944 | 9/1973 |
| GB | 1 493 097 | 11/1977 |
| GB | 1 505 783 | 3/1978 |
| GB | 2 381 443 | 5/2003 |
| JP | 48-22430 | 7/1973 |
| JP | 49-1105 | 1/1974 |
| JP | 52-91558 | 8/1977 |
| JP | 54-6359 | 1/1979 |
| JP | 56-9348 | 1/1981 |
| JP | 57-58352 | 4/1982 |
| JP | 58-46553 | 3/1983 |
| JP | 62-184847 | 11/1987 |
| JP | 64-83229 | 3/1989 |
| JP | 4-132530 | 5/1992 |
| JP | 5-261041 | 10/1993 |
| JP | 10-323303 | 12/1998 |
| JP | 11-56710 | 3/1999 |
| JP | 11-276392 | 10/1999 |
| JP | 2004-167268 | 6/2004 |
| JP | 2006-525845 | 11/2006 |
| JP | 2007-54145 | 3/2007 |
| JP | 2008-86550 | 4/2008 |
| JP | 2009-45440 | 3/2009 |
| KR | 10-2004-0105163 | 12/2004 |
| KR | 10-2009-0000937 | 1/2009 |
| WO | WO-99/34721 | 7/1999 |
| WO | WO-02/26097 | 4/2002 |
| WO | WO-02/085174 | 10/2002 |
| WO | WO-2004/105569 | 12/2004 |
| WO | WO-2005/074778 | 8/2005 |
| WO | WO-2005/087072 | 9/2005 |

OTHER PUBLICATIONS

GB Search Report dated May 5, 2009 directed to counterpart GB Application No. 0904254.0 (1 page).

Dimbylow et al., U.S. Office Action mailed Aug. 16, 2012, directed to U.S. Appl. No. 12/831,841; 12 pages.

Arthey et al., U.S. Office Action mailed Sep. 10, 2012, directed to U.S. Appl. No. 12/831,056; 13 pages.

Gell et al., U.S. Office Action mailed Oct. 12, 2012, directed to U.S. Appl. No. 12/813,264; 12 pages.

* cited by examiner

SURFACE TREATING HEAD

REFERENCE TO RELATED APPLICATIONS

This application claims the priority of United Kingdom Application No. 0904254.0 filed Mar. 12, 2009, the entire contents of which are incorporated herein by reference.

FIELD OF THE INVENTION

This invention relates to a surface treating head which can be used with, or form part of, a surface treating appliance such as a vacuum cleaner.

BACKGROUND OF THE INVENTION

Vacuum cleaners are generally supplied with a range of tools for dealing with specific types of cleaning. The tools include a floor tool for general on-the-floor cleaning. Efforts have been made to improve the pick up performance of floor tools on carpeted floors. Some tools have a brush mounted in the suction inlet which is rotated so as to agitate the floor surface in the same manner as the brush bar of an upright vacuum cleaner. The brush can be rotated by the use of an air turbine or by an electric motor which is powered by a power supply derived from the main body of the cleaner. However, this type of tool is typically more expensive than the passive floor tool and consumes power.

Efforts have also been made to improve floor tools in a more passive manner. For example, EP 1 320 317 discloses a floor tool having a suction channel bounded on at least one side by a working edge for engaging with and agitating the floor surface. Lint pickers on the underside of the tool act as a one-way gate, allowing hair, fluff and other fibrous material to pass under the lint picker when the floor tool is pushed along the floor, but to block the lint when the floor tool is pulled backwards. The repeated forward and backwards action of the floor tool across the floor surface traps the lint and rolls it into a ball such that it can be sucked by the floor tool.

Another improvement is disclosed in GB 1,077,574, which discloses a tool having two discrete suction apertures with a duct interposed between them and extending across the width of the tool, the ends of the duct being open to the atmosphere. Such a tool gives good pick-up performance but the provision of the intervening air duct makes the overall size of the tool, and in particular its profile, larger than is desirable.

SUMMARY OF THE INVENTION

The present invention provides a surface treating head comprising a main body; a suction cavity in the main body comprising first and second suction channels, each of which is bounded on at least one side by a working edge; an outlet; and a fluid flow path in the suction cavity extending from the first channel to the second channel, and from the second channel to the outlet.

In GB 1,077,574, fluid is arranged to flow simultaneously from the first suction channel to an outlet, and from the second suction channel to the outlet, requiring two parallel flow paths to be provided. The provision of a fluid flow path that extends from the first suction channel to the second suction channel, and from there to the outlet, permits a more streamlined tool to be manufactured. The second channel is preferably located between the first channel and the outlet.

Preferably, the head comprises an air duct, open to atmosphere, interposed between the first and second suction channels. This allows air to be drawn in to both sides of both suction channels, improving pick-up performance. The air duct preferably extends between an upper surface and a lower surface of the main body so that air is drawn down to the edges of the suction channels.

Advantageously, the air duct is adjacent at least one working edge, so as to produce a flow of air over the surface of the working edge. This helps to draw into the suction cavity dirt and dust dislodged by action of the working edge on, for example, carpet fibres.

Preferably, each suction channel is bounded on both sides by respective working edges so that the agitation effect of the tool is increased. A further enhancement of agitation may be effected by extending at least one of the working edges so that it occupies the full width of the main body.

Advantageously, part of the fluid flow path is formed by an intermediate channel extending between the first suction channel and the second suction channel. The fluid flow path preferably comprises first and second intermediate channels, which may each extend transversely to the suction channels, preferably at opposite sides of the main body of the tool.

Preferably, the fluid flow path includes a region of increasing cross-sectional area in the direction of flow. The region of increasing cross section may comprise either or both of the suction channels. This arrangement provides a balance of pressure inside the suction cavity so that air is drawn evenly into both suction channels across the full width of the channels.

A bottom surface of the main body may be provided with at least one lint picker to assist with pick up of hair, fluff and other fibres.

A bleed valve may also be provided and arranged, in use, to admit atmospheric air into the tool depending on the pressure in the suction cavity, for example when the pressure falls below a predetermined value. This prevents the main body from being forced down on to a floor surface by atmospheric pressure if the suction cavity becomes temporarily blocked.

A flexible hose preferably extends between the outlet and a connector for connecting the tool to the end of a wand or hose of a cylinder (canister, barrel), upright or handheld vacuum cleaner. Alternatively, the tool can form part of a surface-treating appliance itself, such as the cleaning head of an upright vacuum cleaner or stick vacuum cleaner.

BRIEF DESCRIPTION OF THE DRAWINGS

The invention will now be described, by way of example, with reference to the accompanying drawings, in which:—

DETAILED DESCRIPTION OF THE INVENTION

Figure 1:
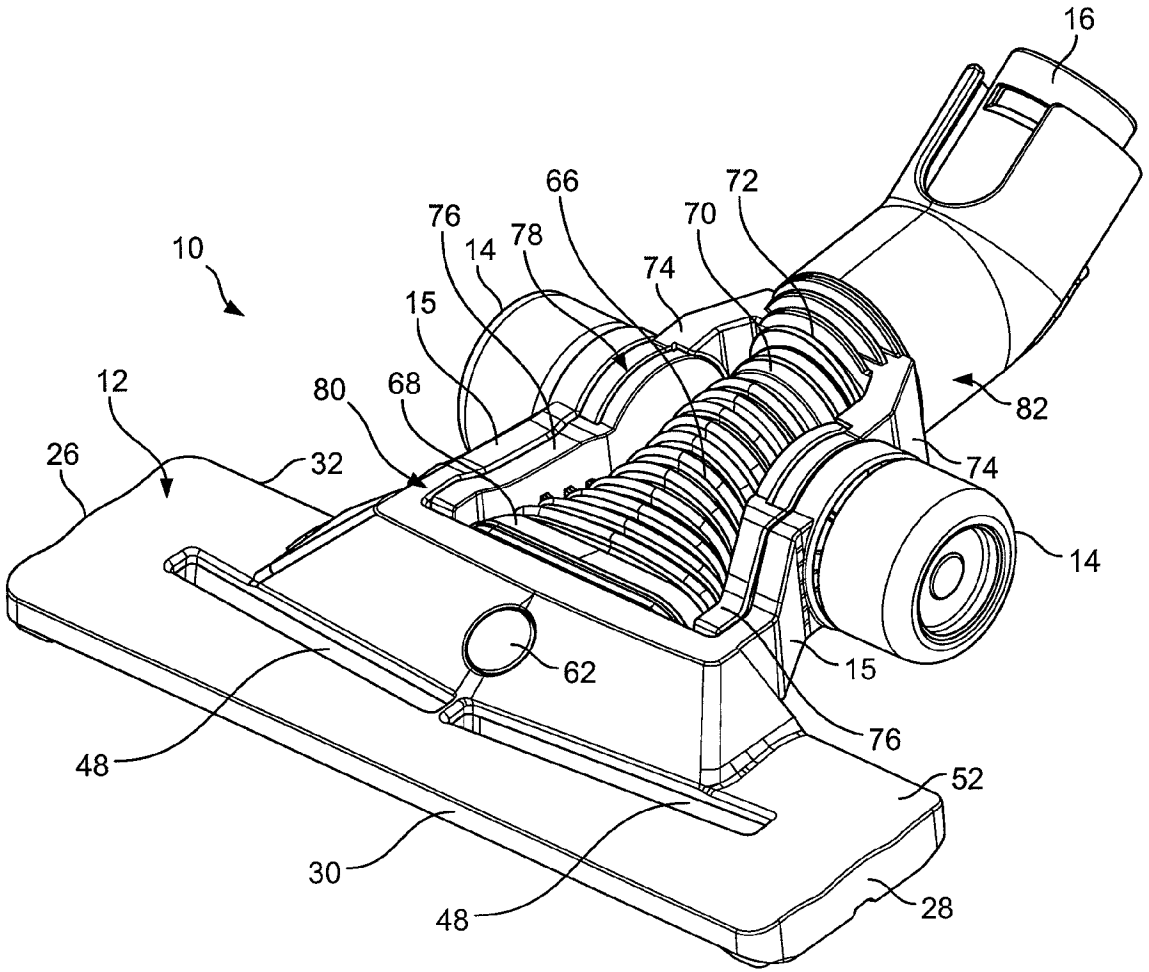
FIG. 1 is a top perspective view of a surface treating head.

FIGS. 1 to 4 and 6 illustrate a surface treating head in the form of a vacuum cleaner floor tool 10. The floor tool 10 comprises a main body 12 and a pair of wheels 14 arranged to allow the floor tool 10 to be manoeuvred over a floor surface. Each wheel 14 is rotatably connected to a respective arm 15 extending rearwardly from the main body 12. The floor tool 10 further comprises a connector 16 having an open end which is connectable to a wand or hose of a vacuum cleaner. The bottom surface 18 of the floor tool 10, which may be integral with the main body 12, delimits a suction cavity 20 of the floor tool 10. In use, the suction cavity 20 faces the floor surface to be cleaned and admits dirt-bearing air from the floor surface into the floor tool 10. A pair of wheels 21 is rotatably mounted within recesses formed in the bottom surface 18 of the main body 12 to space the bottom surface 18 of the floor tool 10 from, for example, a hard floor surface over which the floor tool 10 is being manoeuvred.

The suction cavity 20 comprises a first suction channel 22 and a second suction channel 24, which both extend between opposite side edges 26, 28 of the main body 12 of the floor tool 10. The first suction channel 22 is located towards the front wall 30 of the floor tool 10, with the second suction channel 24 situated towards the rear wall 32 of the floor tool 10. The first and second suction channels 22, 24 have substantially similar external dimensions and are located in the same plane. The second suction channel 24 opens into an outlet 34 located centrally in the rear wall 32 of the main body 12. Intermediate channels 36 provide a fluid connection between the first suction channel 22 and the second suction channel 24. Two intermediate channels 36 are provided, each one located towards a respective side edge 26, 28 of the main body 12. The intermediate channels 36 extend transversely between the suction channels 22, 24. The outside walls of the intermediate channels 36 comprise part of the side edges 26, 28 of the floor tool 10.

Each of the suction channels 22, 24 is bounded by working edges formed by the bottom surface 18 of the floor tool 10. The first suction channel 22 has a front working edge 40 and a rear working edge 42. The second suction channel 24 also has a front working edge 44 and a rear working edge 46. The working edges are sharply defined so as to provide an effective agitating action when the floor tool 10 is used on carpeted surfaces. On such a surface, the wheels 21 sink into the pile of the carpet to bring the working edges into contact with the carpet.

The floor tool 10 further comprises at least one air duct. In this example, the at least one air duct is in the form of two slots 48, each of which is delimited by the rear working edge 42 of the first suction channel 22, the inside wall of an intermediate channel 36 and the front working edge 44 of the rear suction channel 24. Each slot 48 extends from an upper surface 52 of the floor tool 10 down to the bottom surface 18 of the floor tool 10. Each slot 48 is open to atmosphere.

Figure 5B:
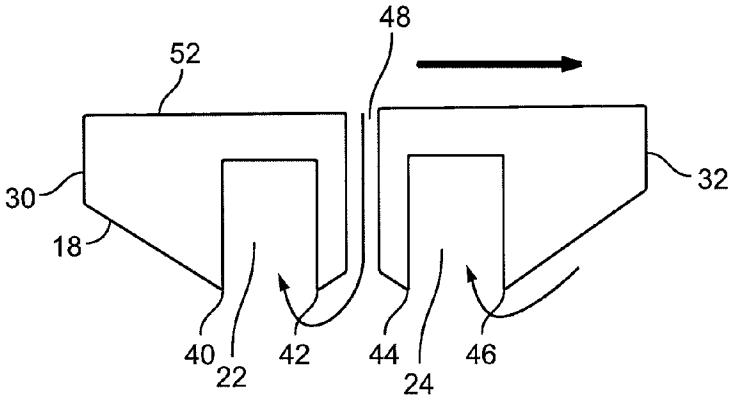
FIG. 5*b* is a schematic side view of the part of FIG. 5*a* in use in a second direction.
Figure 5A:
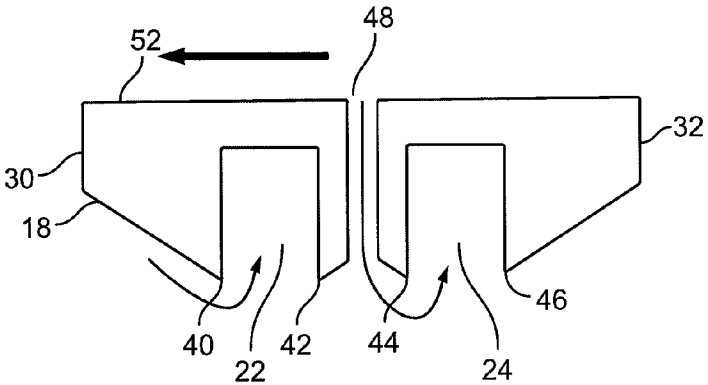
FIG. 5*a* is a schematic side view of part of the head of FIG. 1 in use in a first direction.

FIGS. 5*a* and 5*b* illustrate schematically the function of the air slots 48 and the working edges in use. In FIG. 5*a*, the floor tool 10 is being pushed forwardly along a carpeted floor surface, which direction is represented by the large arrow over the upper surface 52. The floor tool 10 is in fluid communication with a vacuum cleaner which generates a suction airflow, as will be discussed later. On the forward stroke of the floor tool 10, the front working edges 40, 44 of the respective suction channels 22, 24 come into operation. The front working edges 40, 44 open out the pile of the carpet so that suction air can flow about the front working edges 40, 44 and into the suction channels 22, 24, as shown by the smaller arrows. Air is drawn under the front wall 30 of the main body 12, under the front working edge 40 and into the first suction channel 22 of the suction cavity 20. Air from the first suction channel 22 flows through the intermediate channels 36 into the second suction channel 24, and exits the suction cavity 20 through the outlet 34. Air is also drawn in through the air slots 48 from the atmosphere, under the front working edge 44 and into the second suction channel 24 of the suction cavity 20. Air from the second suction channel 24 exits the suction cavity 20 through the outlet 34. The outlet 34 has a flared opening in order to provide a smooth transition between the second suction channel 24 and the outlet 34.

In FIG. 5*b*, the floor tool 10 is being drawn back along the carpeted floor surface, which direction is represented by the large arrow over the upper surface 52. On the backward stroke of the floor tool 10, the rear working edges 42, 46 of the suction channels 22, 24 come into operation. Air is drawn in through the air slots 48 from the atmosphere, under the rear working edge 42 and into the first suction channel 22. Air from the first suction channel 22 flows through the intermediate channels 36 into the second suction channel 24, and exits the suction cavity 20 through the outlet 34. Air is also drawn under the rear wall 32 of the main body 12, under the rear working edge 46 and into the second suction channel 24. Air from the second suction channel 24 exits the suction cavity 20 through the outlet 34.

Thus, for each stroke of the floor tool 10, a plurality of working edges comes into effect, such that pick-up of dirt and dust is improved in comparison with conventional floor tools having one suction channel and two working edges only. By providing a fluid connection between the first and second channels 22, 24 that extends along the side walls 26, 28 of the floor tool 10, a floor tool having multiple suction channels and working edges can be manufactured having similar dimensions to a conventional, single suction channel floor tool. In particular, the depth of the floor tool 10 can be made to be relatively small so that the floor tool 10 has a low profile. This benefit is most noticeable in FIGS. 3 and 4.

Figure 2:
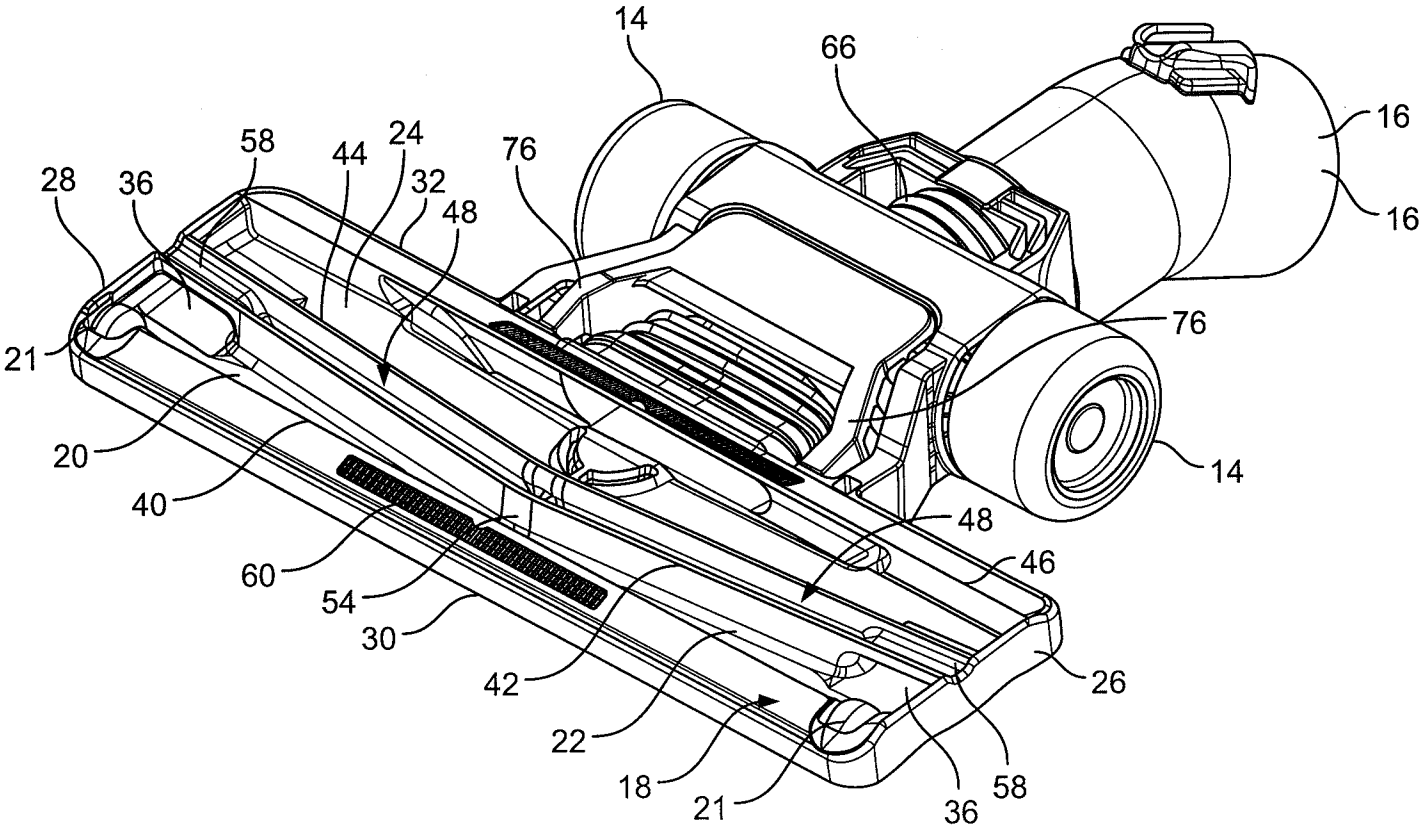
FIG. 2 is a bottom perspective view of the head of FIG. 1.
Figure 3:
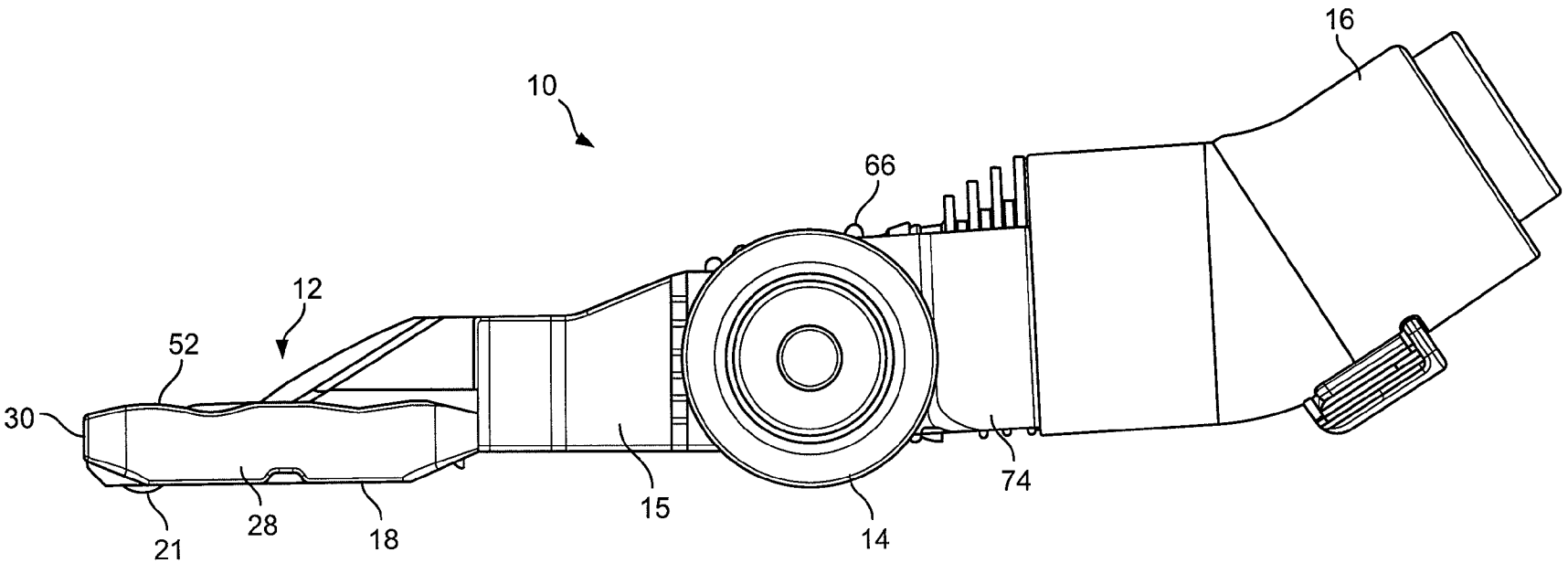
FIG. 3 is a side view of the head of FIG. 1.
Figure 4:
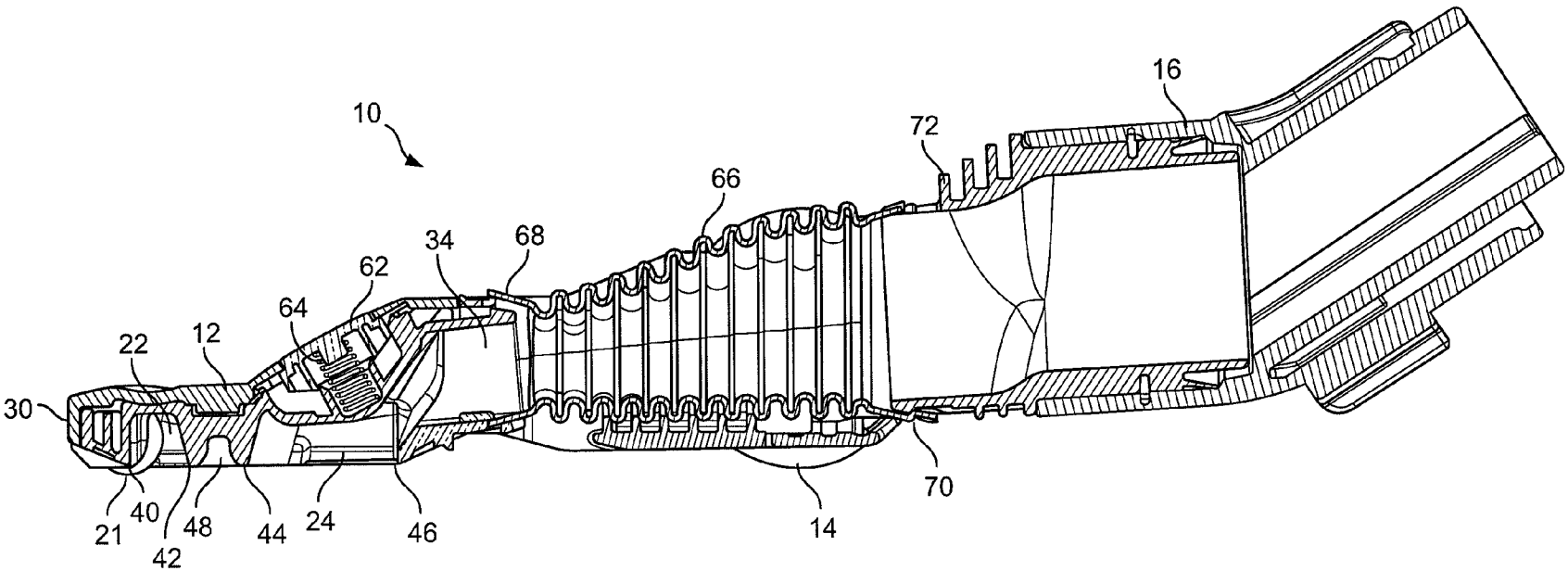
FIG. 4 is a sectional side view of the head of FIG. 1.
Figure 6:
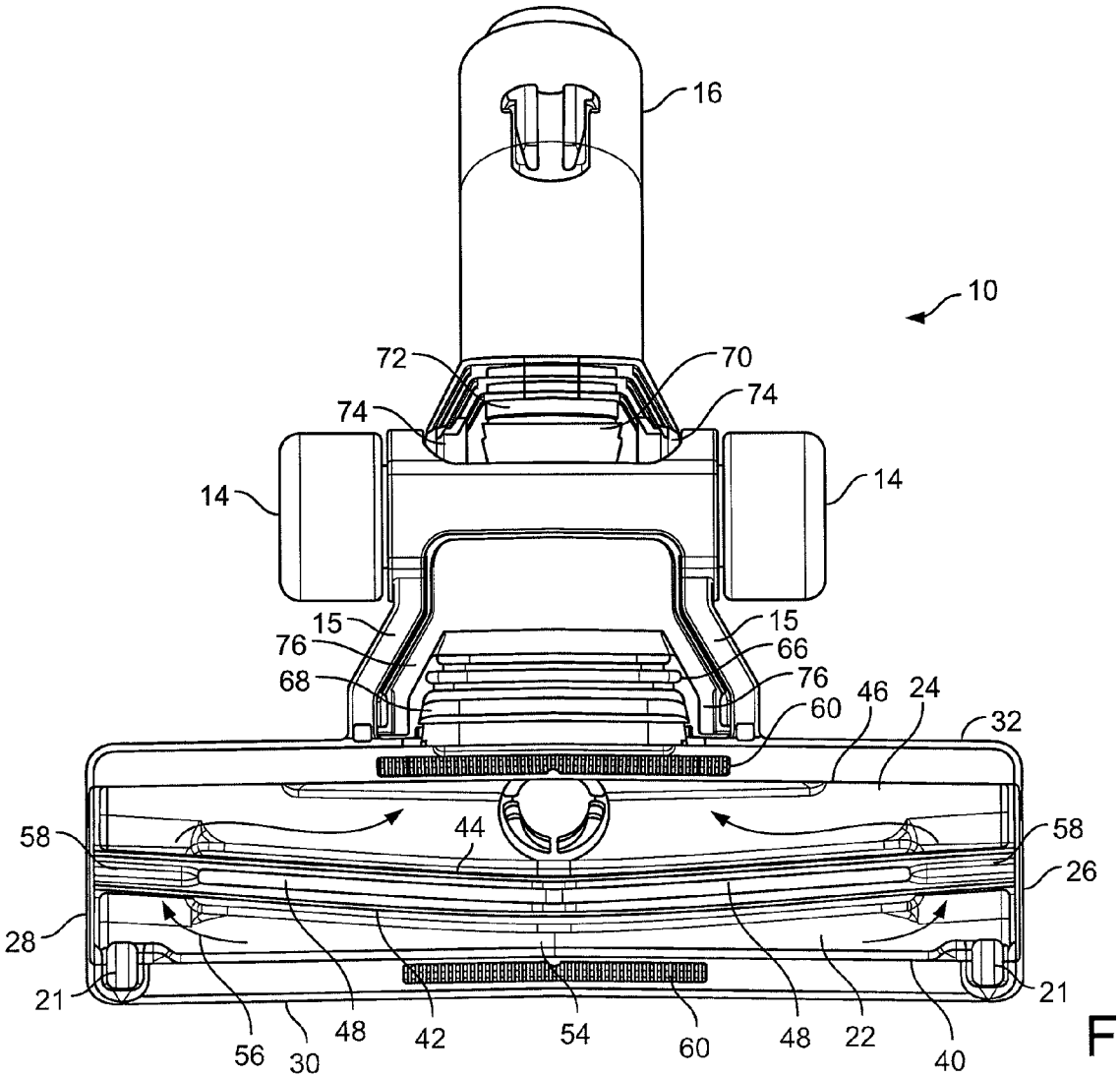
FIG. 6 is a bottom view of the head of FIG. 1.

Details of the suction cavity 20 are visible in FIGS. 2 and 6, which illustrate in more detail the underside of part of the floor tool 10. The suction cavity 20 does not have a uniform cross section. The first suction channel 22 has a central region 54 which has the smallest cross-sectional area of the suction cavity 20. The cross-sectional area increases along the portion of the fluid flow path 56 (indicated in FIG. 6) that extends from the central region 54 along the rest of the first suction channel 22 to its outer edges adjacent the side walls 26, 28 of the floor tool 10. The cross-sectional area of the suction cavity 20 is substantially constant along the portion of the fluid flow path 56 that extends from the first suction channel 22 along the intermediate channels 36 to the second suction channel 24. The cross-sectional area of the suction cavity 20 increases further along the portion of the fluid flow path 56 that extends from the intermediate channels 36 along the second suction channel 24 to the outlet 34 located in a central portion of the rear wall 32 of the main body 12. In order to accommodate this shape of the suction cavity 20, the air slots 48 are arranged to be, in combination, chevron-shaped, with an apex adjacent the central region 54 of the first suction channel 22. By arranging for the suction cavity 20 to have an increasing cross-section along at least part of the fluid flow path 56, a substantially constant fluid pressure is maintained throughout the suction cavity 20. This provides a further benefit in performance, as it ensures that air is drawn evenly into both suction channels 22, 24 across the full width of the suction channels 22, 24.

The front working edge 40 and the rear working edge 46 extend across the width of the main body 12 of the floor tool 10. In order to further increase the effect of the working edges 42, 44 that are adjacent the air slots 48, these edges are extended to the side wall 26, 28 by way of bridges 58 that traverse the intermediate channels 36. The bridges 58 extend from opposite edges of the air slots 48 to the side walls 26, 28 and also provide small passageways for fluid to flow from the side walls under and along the portions of the working edges 42, 44 formed by the bridges 58. The bridges 58 may form an integral part of the bottom surface 18 of the floor tool 10. By providing working edges that extend substantially the full width of the floor tool 10, a greater agitation effect can be achieved.

Lint pickers 60 are provided on the bottom surface 18 of the floor tool 10 at the front and rear portions of the floor tool 10, spaced from the working edges 40, 46. Each of the lint pickers 60 comprises a strip of material in which a plurality of tufts of fine fibre is secured. The repeated forward and backwards action of the floor tool 10 across the floor surface traps hair, fluff and other fibrous material and rolls it into a ball such that it can be sucked into the suction cavity 20. The use of lint pickers 60 causes an increase in the force that a user requires to push or pull the floor tool 10 across a floor surface. It would be possible to increase the width of the lint pickers 60 to substantially the total width of the floor tool although this would incur an increase in the push force required by a user.

A bleed valve 62 is provided in the upper surface 52 of the floor tool 10. In the event that the suction cavity 20 becomes blocked by, for example, fabric being drawn into the suction channels 22, 24, the pressure inside the suction cavity 20 will drop. When the pressure inside the suction cavity 20 falls below a predetermined value, atmospheric pressure acts on the bleed valve 62 and urges it inwardly against the force of a spring 64, thus providing an opening for atmospheric air to enter the floor tool 10. When the blockage is removed, the force of the spring 22 urges the bleed valve 62 back into its original position, flush with the upper surface 52.

In order to obtain the best possible performance from the floor tool 10, it is important that the working edges remain in contact with the floor as the floor tool 10 is pulled and pushed along a floor surface. In order to achieve this, articulation is provided between the outlet 34 and the connector 16 that connects with a wand or hose of a vacuum cleaner. Articulation is provided in the form of a flexible internal hose 66. One end portion 68 of the internal hose 66 has a wide mouth that fits over and seals against the slot-shaped outlet 34 of the suction cavity 20. The other end portion 70 of the internal hose 66 has a circular cross-section and is arranged to fit over and seal against a neck 72 that, in turns, fits inside the connector 16. The neck 72 is connected to, preferably integral with, a second pair of arms 74 which extend towards the main body 12 of the floor tool 10. Each arm 74 is pivotably connected towards one end thereof to a first end of a respective one of a third pair of arms 76. This provides a first articulated joint 78 of the floor tool 10. The second end of each of the arms 76 is pivotably connected to a respective arm 15 of the main body 12 of the floor tool 10. This provides a second articulated joint 80 of the floor tool 10. The first and second joints 78, 80 pivot about axes that are parallel with the floor surface. The internal hose 66 provides a reliable seal of the airway between the outlet 34 and the connector 16 whilst allowing movement and flexibility.

The connector 16 is arranged to rotate with respect to the neck 72 about an axis that is orthogonal to the axes of the first and second joints 78, 80. The rotatable connection of the neck 74 with the connector 16 forms a third joint 82, which allows the tool to move laterally. In use, the three joints allow the floor tool 10 to be manipulated and steered whilst maintaining contact of the working edges with the carpet, so that the pick-up performance of the tool is increased. The double articulation arrangement of the first and second joints 78, 80 allows forces applied to the floor tool 10 by the user to be transmitted through the wheels 14 of the floor tool 10. This helps to reduce motion resistance and also allows the user to complete a longer stroke whilst keeping the floor tool 10 flat to the floor surface.

Figure 7B:
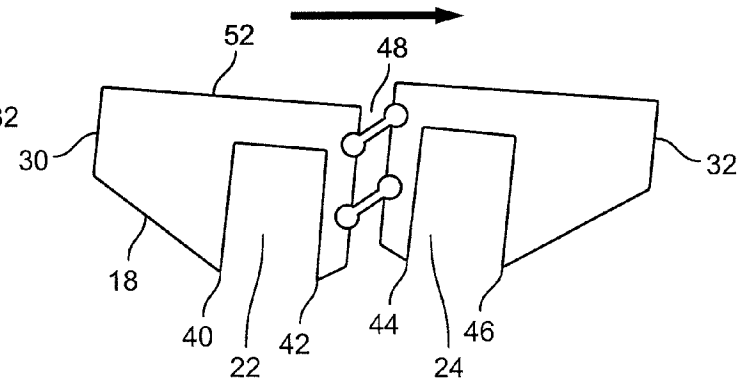
FIG. 7*b* is a schematic side view of the part of FIG. 7*a* in use in a second direction.
Figure 7A:
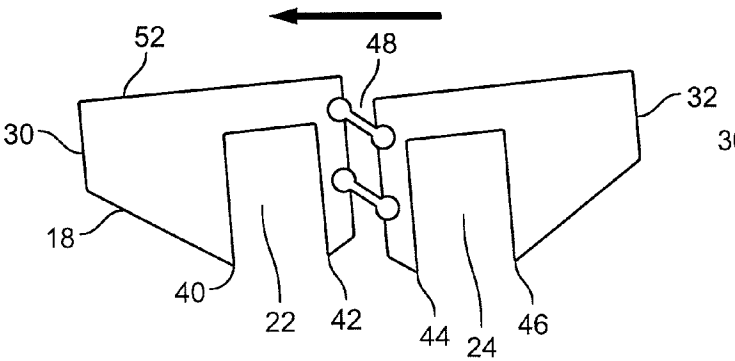
FIG. 7*a* is a schematic side view of an alternative to the part shown in FIG. 5*a*, in use in a first direction.

FIGS. 7*a* and 7*b* illustrate an articulated alternative to the parts shown in FIGS. 5*a* and 5*b*. In this alternative, the first and second suction channels 22, 24 are articulated with respect to each other. Flexible joints 84 connect the first suction channel 22 to the second suction channel 24. In FIG. 7*a*, the floor tool 10 is being pushed forwardly along a carpeted floor surface, which direction is represented by the large arrow over the upper surface 52. On the forward stroke of the floor tool 10, the flexible joints 84 allow the first and second suction channels 22, 24 to pivot forwardly, lowering the working edges 40, 44 so that they are brought into engagement with the floor surface. On the reverse stroke, as shown in FIG. 7*b*, the flexible joints 84 allow the first and second suction channels 22, 24 to pivot rearwardly, lowering the working edges 42, 46 towards the floor surface. This embodiment keeps the working edges in engagement with the floor surface in a variety of working positions of the floor tool 10 even if the connection between the outlet 34 and the connector 16 is rigid.

Figure 8:
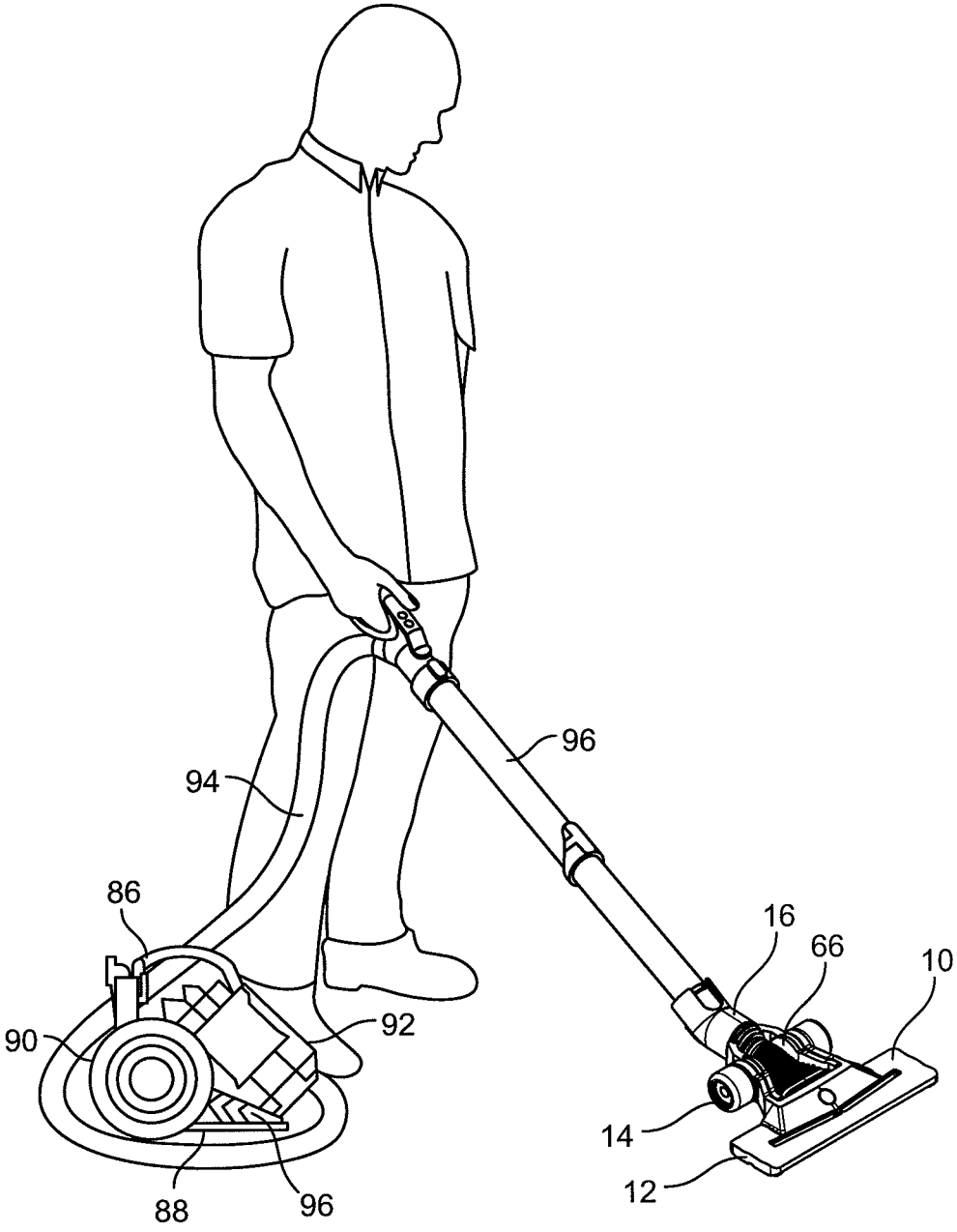
FIG. 8 is a side view of a vacuum cleaner incorporating the head of FIG. 1 in use.

FIG. 8 shows the floor tool 10 as part of a surface-treating appliance in the form of a cyclonic vacuum cleaner 86. The vacuum cleaner 86 has a main body 88 housing a motor and fan unit (not shown). The main body 88 includes means for allowing the vacuum cleaner 86 travel across a floor surface, which, in this embodiment, comprises a pair of wheels 90. Separating apparatus in the form of a cyclonic separator 92 is releasably attached to the main body 88. A flexible hose 94 is connectable to an inlet port on the main body 88. The other end of the flexible hose 94 is connectable to a wand 96, the distal end of which is adapted to receive the connector 16 of the floor tool 10. The connector 16 could also be connected directly to the hose 94. During use, the main body 88 of the vacuum cleaner 86 is pulled along the floor surface by the flexible hose 94 as a user moves around a room. When the user switches on the vacuum cleaner 86, the motor is energized and drives a fan so as to draw in dirty air through the floor tool 10. The dirty air, carrying dirt and dust from the floor surface, is drawn through the wand 96 and hose 94 and into the cyclonic separator 92 via the inlet port.

The cyclonic separator 92 includes an upstream cyclone followed by a plurality of downstream cyclones. Air entering the cyclonic separator 92 is encouraged to follow a helical path around the interior of the cyclones. Dirt and dust becomes separated from the swirling flow of air. The cleaned air then passes from the cyclonic separator 92 into the main body 88 of the vacuum cleaner 86. The cleaned air then travels sequentially through a pre-motor filter, the motor and fan unit and then a post-motor filter before exiting the vacuum cleaner 86 through an exhaust 98.

The low profile of the floor tool 10 allows it to be employed under low furniture and other obstacles. Manufacture of such a low profile tool is possible due to the provision of a fluid flow path 56 that extends from the first suction channel 22 to the second suction channel 24 and from there to the outlet 34. The working edges and the air slots 48 together produce an effective agitating action, which is beneficial in dislodging dirt and dust from the pile of carpets. The agitating action may be at least as good as that achievable by a driven brush bar.

The appliance need not be a cyclonic vacuum cleaner. The invention is applicable to other types of surface treating head for vacuum cleaners, for example heads and tools of upright machines, stick-vacuums or hand-held cleaners. Further, the present invention is applicable to other types of cleaning head, for example, the head of a wet and dry machine or a carpet shampooer, and surface-treating heads in general—such as those employed in polishing/waxing machines, pressure washing machines, ground marking machines and lawn mowers.

The invention has been described with reference to a passive tool but is equally suitable in connection with a tool employing an agitator, such as a brush bar or beater, driven by a motor or turbine.

Further suction channels may be provided, each of which is bounded by at least one, and preferably two working edges. Each extra suction channel may be separated from its neighbour by further atmospheric air ducts. The (or each) atmospheric air may comprise a single opening or a plurality of smaller slots, nozzles or ducts. The provision of atmospheric air passageways of relatively small dimensions may help to form high-pressure jets of air close to the working edges to further dislodge debris from the carpet. By providing several atmospheric air ducts instead of a single uninterrupted duct, the robustness of the floor tool may be improved.

Further variations will be apparent to the person skilled in the art. For example, at least one of the lint pickers may be omitted or replaced by strips of felt, rows of bristles or combs.

The invention claimed is:

1. A surface treating head comprising a main body; a suction cavity in the main body comprising first and second suction channels; an outlet; and a fluid flow path in the suction cavity extending from the first suction channel to the second suction channel, and from the second suction channel to the outlet, wherein each suction channel is bounded by a front working edge and a rear working edge, the head comprising an air through the main body duct, open to the atmosphere, interposed between the first and second suction channels for conveying air towards the rear working edge of the first suction channel and towards the front working edge of the second suction channel and into the suction channels.

2. A surface treating head as claimed in claim 1, wherein the second suction channel is located between the first suction channel and the outlet.

3. A surface treating head as claimed in claim 1, wherein the air duct extends between upper and lower surfaces of the main body.

4. A surface treating head as claimed in claim 1, wherein at least one working edge extends substantially the full width of the main body.

5. A surface treating head as claimed in claim 1, wherein the fluid flow path includes an intermediate channel between the first and second suction channels.

6. A surface treating head as claimed in claim 5, wherein the fluid flow path includes a second intermediate channel between the first and second suction channels.

7. A surface treating head as claimed in claim 6, wherein the intermediate channels extend transversely to the first and second suction channels.

8. A surface treating head as claimed in claim 6, wherein the intermediate channels are located on opposite side portions of the main body.

9. A surface treating head as claimed in claim 1, wherein the fluid flow path includes a region of increasing cross section in the direction of flow.

10. A surface treating head as claimed in claim 9, wherein the region of increasing cross section comprises the first suction channel.

11. A surface treating head as claimed in claim 9, wherein the region of increasing cross section comprises the second suction channel.

12. A surface treating head as claimed in claim 1, comprising a bottom surface having at least one lint picker.

13. A surface treating head as claimed in claim 1, comprising a bleed valve arranged, in use, to admit atmospheric air into the head depending on the pressure in the suction cavity.

14. A surface treating head as claimed in claim 1, comprising a flexible hose extending between the outlet and a connector.

15. A surface treating head as claimed in claim 14, wherein the connector is arranged to be connectable to the hose or wand of a surface-treating appliance.

16. A surface treating appliance incorporating a surface treating head as claimed in claim 1.

17. A surface treating appliance as claimed in claim 16, in the form of a vacuum cleaner.

* * * * *